US009103163B2

(12) United States Patent
McCue et al.

(10) Patent No.: US 9,103,163 B2
(45) Date of Patent: Aug. 11, 2015

(54) DOOR FRAME PROTECTION APPARATUS

(71) Applicant: McCue Corporation, Peabody, MA (US)

(72) Inventors: David McCue, Manchester, MA (US); Thomas Montgomery, Newfields, NH (US); Teodoro Mesa, Lynn, MA (US); Thomas Ustach, Melrose, MA (US); Timothy David Stratford, Milton Keynes (GB); Robert Davidson, Market Harborough (GB); Russell Harris, Leighton Buzzard (GB)

(73) Assignee: McCue Corporation, Peabody, MA (US)

( * ) Notice: Subject to any disclaimer, the term of this patent is extended or adjusted under 35 U.S.C. 154(b) by 0 days.

(21) Appl. No.: 14/264,288

(22) Filed: Apr. 29, 2014

(65) Prior Publication Data

US 2014/0318052 A1 Oct. 30, 2014

Related U.S. Application Data

(60) Provisional application No. 61/953,166, filed on Mar. 14, 2014.

(30) Foreign Application Priority Data

Apr. 29, 2013 (GB) ..... 1307713.6

(51) Int. Cl.

| | |
|---|---|
| ***E04F 19/02*** | (2006.01) |
| ***E06B 3/88*** | (2006.01) |
| ***E06B 1/52*** | (2006.01) |
| ***E01F 15/14*** | (2006.01) |

(52) U.S. Cl.
CPC ..... *E06B 3/88* (2013.01); *E01F 15/141* (2013.01); *E06B 1/52* (2013.01)

(58) Field of Classification Search
CPC ..... E06B 3/88; E06B 1/52; E01F 15/141
USPC ..... 52/204.1, 211
See application file for complete search history.

(56) References Cited

U.S. PATENT DOCUMENTS

| | | | | |
|---|---|---|---|---|
| 4,183,505 | A * | 1/1980 | Maestri | 256/13.1 |
| 4,989,835 | A * | 2/1991 | Hirsh | 256/13.1 |
| 5,630,302 | A * | 5/1997 | Rosenband | 52/239 |
| 5,809,733 | A * | 9/1998 | Venegas, Jr. | 52/835 |
| 8,820,722 | B2 * | 9/2014 | Reinert, Sr. | 256/65.14 |
| 2008/0256881 | A1 * | 10/2008 | Lowry et al. | 52/212 |
| 2010/0212227 | A1 * | 8/2010 | Perkins et al. | 49/70 |
| 2012/0104320 | A1 * | 5/2012 | Postma | 252/301.36 |

(Continued)

*Primary Examiner* — Mark Wendell
*Assistant Examiner* — Keith Minter
(74) *Attorney, Agent, or Firm* — Occhiuti & Rohlicek LLP

(57) ABSTRACT

A door frame protection apparatus includes a first upright bar having a first end and a second end, the first end being anchored to a surface at a first anchor point, a second upright bar having a third end and a fourth end, the third end being anchored to the surface at a second anchor point, an overhead crossbar coupled to the second end of the first upright bar and to the fourth end of the second upright bar, a first impact absorption member resting on the first anchor point and having the first upright bar extending therethrough, the first impact absorption member being rotatable about the first upright bar, and a second impact absorption member resting on the second anchor point and having the second upright bar extending therethrough, the second impact absorption member being rotatable about the second upright bar.

20 Claims, 3 Drawing Sheets

(56) References Cited

U.S. PATENT DOCUMENTS

2014/0069046 A1* 3/2014 Cai et al. ..... 52/651.01
2014/0140764 A1* 5/2014 Stratford ..... 404/6
2014/0154007 A1* 6/2014 Ustach et al. ..... 404/6

* cited by examiner

DOOR FRAME PROTECTION APPARATUS

CROSS-REFERENCE TO RELATED APPLICATIONS

Under 35 USC 119, this application claims the benefit of the priority date of U.K. Application No. GB1307713.6, filed on Apr. 29, 2013, the content of which is herein incorporated by reference. This application also claims the benefit of U.S. Provisional Application No. 61/953,166 filed Mar. 14, 2014 which is incorporated herein by reference.

BACKGROUND

This invention relates to an apparatus for protecting a door frame.

Warehouses, distributions centers, factories, and similar facilities often have large stock handling equipment such as fork trucks which frequently move stock into, out of, and around the facility. In some examples, a piece of large stock handling equipment (e.g., a fork truck) retrieves stock from one location in a facility (e.g. from a shelf), transports the stock through the facility to a destination location (e.g., a loading dock). As the fork truck transports the stock through the facility it may pass through a number of doorways in the facility.

The doorways in warehouses, distribution centers, factories, and similar facilities often include shutter-type overhead roll-up doors. These doors include a motorized rolling mechanism installed above the doorway which is used to lower the door into a closed position or to retract the door into an open position. In the open, retracted position, the door is rolled onto a cylinder. Shutter tracks, which guide the shutter-type door as it is lowered and retracted, are often installed on the sides of the doorways.

SUMMARY

It is often the case that warehouses, distribution centers, factories, and similar facilities have a high amount of stock handling equipment traffic. As operators navigate through the doorways in the facility, the stock handling equipment may occasionally make contact with the door frames of the doorways and certain components of the shutter-type overhead roll-up doors installed thereon. In one example, a fork truck may make contact with the side of the doorway, possibly contacting and damaging the door's shutter tracks. In another example, a fork truck may have its mast deployed to an extent that it makes contact with rolled door and/or the motorized rolling mechanism, possibly causing damage to the door and/or rolling mechanism. In another example, where no shutter-type roll-up door is installed on a doorway, a fork truck may make contact and damage the top or sides of the door frame.

In a general aspect, a door frame protection apparatus prevents damage to door mechanisms and frames by placing a barrier around a perimeter of the doorway. The barrier prevents stock handling equipment from making contact with the doorway or the doors installed thereon. The barrier includes two upright bars installed in front of the sides of the doorway and a crossbar, connecting the tops of the two upright bars, installed in front of the top of the doorway.

Each of the upright bars has a rotatable cylindrical bumper installed thereon. The rotatable cylindrical bumper is configured to absorb and deflect inadvertent impacts by stock handling equipment. The overhead bar is configured enforce height restrictions for stock handling equipment masts by absorbing any impacts by the masts.

In a general aspect, a door frame protection apparatus includes a first upright bar having a first end and a second end, the first end being anchored to a surface at a first anchor point, a second upright bar having a third end and a fourth end, the third end being anchored to the surface at a second anchor point, an overhead crossbar coupled to the second end of the first upright bar and to the fourth end of the second upright bar, a first impact absorption member resting on the first anchor point and having the first upright bar extending therethrough, the first impact absorption member being rotatable about the first upright bar, and a second impact absorption member resting on the second anchor point and having the second upright bar extending therethrough, the second impact absorption member being rotatable about the second upright bar.

Aspects may include one or more of the following features.

The overhead crossbar may be removable. The second end of the first upright bar may include a first rotatable member configured to receive a first portion of the overhead crossbar and the fourth end of the second upright bar may include a second rotatable member configured to receive a second portion of the overhead crossbar. The first rotatable member may include a first semi-circular cut-out for receiving the first portion of the crossbar and the second rotatable member may include a second semi-circular cut-out for receiving the second portion of the crossbar. The first impact absorption may have a circular horizontal cross-section and the second impact absorption member has a circular horizontal cross-section.

In another general aspect, an opening protection system includes two spaced-apart ground-anchored upright posts, a cross-bar connected to each post at a top region of the respective post, two ground-contacting covers, each positioned around a respective post and free to rotate around the respective post, and two guards, each positioned around a respective post and free to rotate around the respective post.

Aspects may include one or more of the following features.

Each guard may be in contact with a ground-contacting cover. The outer surface of each ground-contacting cover may be circular in horizontal cross-section. The outer surface of each guard may be circular in horizontal cross-section. The diameter of the ground-contacting covers may be greater than the diameter of the guards. The system may also include two ground-contacting base boxes, each positioned at a bottom region of the respective post. Each guard may be mounted on a respective ground-contacting base box.

In another general aspect, a method of installing an opening protection system includes ground-anchoring two spaced-apart upright posts, connecting a cross-bar to each post at a top region of the respective post, positioning two ground-contacting covers around a respective post that are free to rotate around the respective post, and positioning two guards around a respective post that are free to rotate around the respective post.

Aspects may include one or more of the following features.

Each guard may be in contact with a ground-contacting cover. The outer surface of each ground-contacting cover may be circular in horizontal cross-section. The outer surface of each guard may be circular in horizontal cross-section. The diameter of the ground-contacting covers may be greater than the diameter of the guards. The method may also include positioning two ground-contacting base boxes at a bottom region of a respective post. Each guard may be mounted on a respective ground-contacting base box.

Aspects may have one or more of the following advantages.

Among other advantages, the door frame protection apparatus has high visibility (e.g., black and yellow) coloring, making the height and width of the doorway highly visible to operators of stock handling equipment.

The overhead crossbar of the door frame protection apparatus prevents over-height masts of stock handling equipment from making contact with and damaging the door and/or the motorized rolling mechanism of a shutter-type roll-up door.

The overhead crossbar is removable, allowing for replacement of the crossbar if damaged.

The rotatable cups on the top ends of the upright bars facilitate a simple installation and alignment process in that the two upright bars can be installed free standing and uncoupled to the cross bar. The rotational freedom of the cup then allows for installation of the crossbar onto the installed uprights by aligning the cups to accommodate the crossbar without requiring any rotational adjustment to the upright bars themselves.

The upright bars of the door frame protection apparatus prevent stock handling equipment from impacting and damaging the sides of a doorway and any shutter tracks installed thereon.

The cylindrical bumpers are made from plastic having high visibility coloring. Since no painting or repainting of the plastic is required, maintenance is drastically reduced.

The rotational capability of the cylindrical bumpers deflects the impact of stock handling equipment and prevents snagging of the equipment on the door frame protection apparatus and the door frame itself Other features and advantages of the invention are apparent from the following description, and from the claims.

DESCRIPTION

Figure 1:
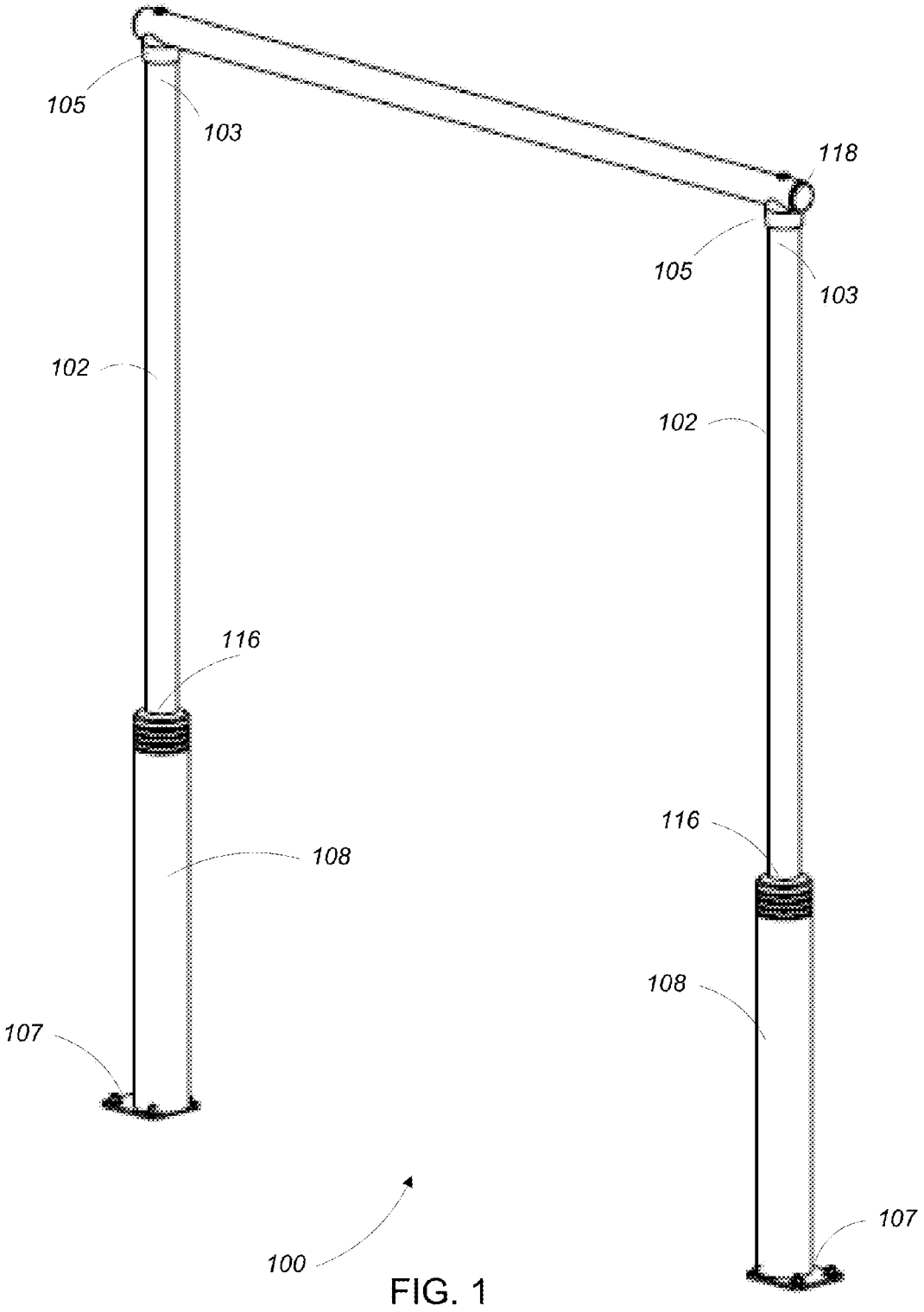
FIG. 1 is a perspective view of the door frame protection apparatus.

Referring to FIG. 1, a door frame protection apparatus 100 includes two cylindrical upright bars 102, each of which is anchored into the ground at an anchor point 107. The top ends 103 of the upright bars 102 are connected by a cylindrical overhead crossbar 104.

Each of the upright bars 102 has a cylindrical bumper 108 (sometimes referred to as a "shin guard") installed thereon. The cylindrical bumper 108 is a hollow cylindrical member which includes a through hole 116. The through hole 116 has substantially the same diameter as the upright bar 102. The cylindrical bumper 108 is installed on the upright bar 102 with the upright bar 102 extending through the through hole 116 of the cylindrical bumper 108. In its installed position the cylindrical bumper 108 rests on top of the anchor point 107 of the upright bar 102. In some examples, the cylindrical bumper 108 is made of a high density polyethylene (HDPE). The cylindrical bumper 108 is free to rotate about the upright bar 102.

In some examples, a rotatable cup 105 is placed the top end 103 of each of the upright bars 102. The rotatable cup 105 is shaped to conform to the outer surface of the crossbar 104 and is free to rotate about the upright bar 102. The crossbar 104 is placed into the rotatable cups 105 at the top ends 103 of the upright bars 102 and is attached to the top ends 103 using bolts or some other removable fastener. In this way the crossbar 104 can be easily removed and replaced if it is damaged. In some examples, the ends of the crossbar 104 are capped using plastic plugs 118.

Figure 2:
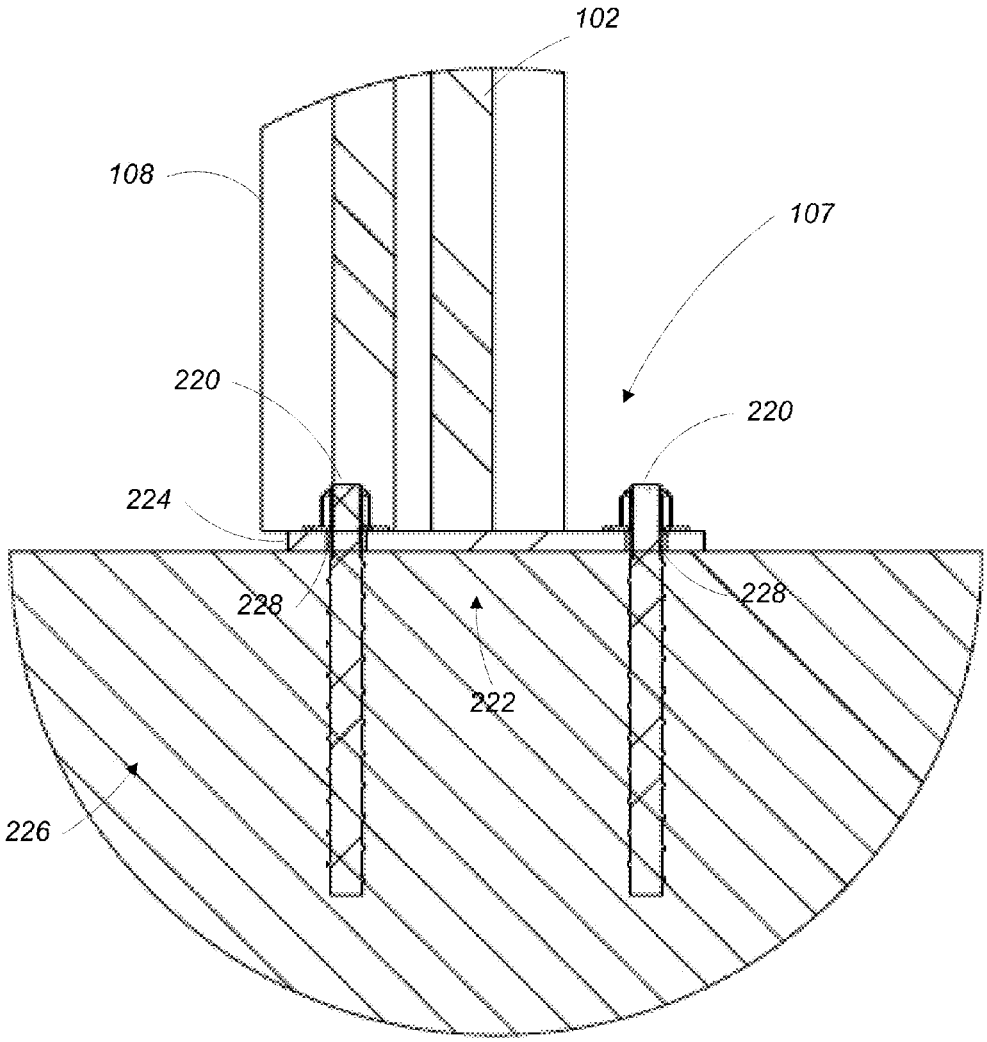
FIG. 2 is a cross-sectional view of the anchoring portion of one of the upright bars.

Referring to FIG. 2, a cross sectional view of the anchor point 107 of one of the upright bars 102 includes a portion of the upright bar 102, a portion of the cylindrical bumper 108, and a number of fixing bolts 220. A bottom end 222 of the upright bar 102 includes a fixing plate 224 which rests on the ground 226. The fixing plate 224 has a number of holes 228 through which the fixing bolts 220 can be inserted. The fixing bolts 220 extend through the holes 228 of the fixing plate 224 and into the ground 226 where they anchor the upright bar 102 to the ground.

Alternatives

In some examples, the cylindrical bumper is made from an HDPE material having a high visibility color (e.g. yellow). In some examples, the cylindrical bumper is colored with an alternating pattern of black and a high visibility color (e.g., the cylindrical bumper is horizontally striped).

In some examples where the upright bars and the overhead crossbar are made of metal (e.g., steel), the upright bars and the overhead crossbar are painted with a high visibility paint color (e.g., yellow). In other examples, the upright bars 102 and the overhead crossbar 104 may be made from an HDPE material having a high visibility color.

In some examples, the bolts used to anchor the upright bars to the ground are secured into the ground using an epoxy resin anchor foundation.

Figure 3:
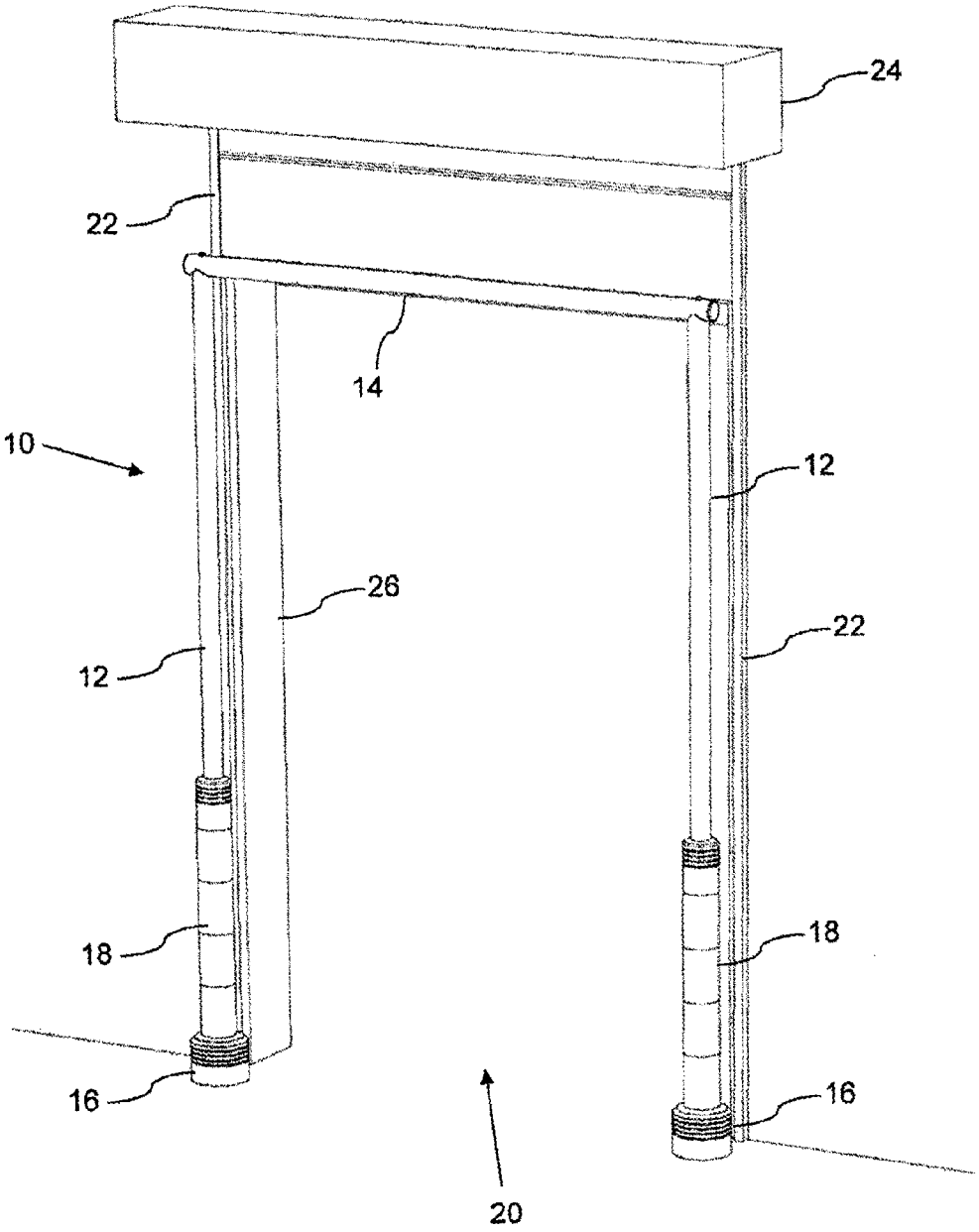
FIG. 3 is a perspective view of an opening protection system.

Referring to FIG. 3, in some examples, each guard (e.g. 18) is in contact with a ground-contacting cover or "ground-contacting base box" (e.g., 16).

It is to be understood that the foregoing description is intended to illustrate and not to limit the scope of the invention, which is defined by the scope of the appended claims. Other embodiments are within the scope of the following claims.

What is claimed is:

1. A door frame protection apparatus comprising:

a first upright bar having a first end and a second end, the first end being anchored to a surface at a first anchor point and the second end including a first groove;

a second upright bar having a third end and a fourth end, the third end being anchored to the surface at a second anchor point and the fourth end including a second groove;

an overhead crossbar having a first portion resting in and having a shape conforming to the first groove and coupled to the second end of the first upright bar and having a second portion resting in and having a shape conforming to the second groove and coupled to the fourth end of the second upright bar;

a first impact absorption member resting on the first anchor point and having the first upright bar extending therethrough, the first impact absorption member being rotatable about the first upright bar; and a second impact absorption member resting on the second anchor point and having the second upright bar extending therethrough, the second impact absorption member being rotatable about the second upright bar.

2. The apparatus of claim 1 wherein the second end of the first upright bar includes a first rotatable member including the first groove and the fourth end of the second upright bar includes a second rotatable member including the second groove.

3. The apparatus of claim 1 wherein the first impact absorption member has a circular horizontal cross-section and the second impact absorption member has a circular horizontal cross-section.

4. The door frame protection apparatus of claim 1 wherein the first groove has a semi-circular shape and the second groove has a semi-circular shape.

5. An opening protection system comprising:

two spaced-apart ground-anchored upright posts, a first upright post of the two upright posts having a first end including a first groove and a second upright post of the two upright posts having a second end including a second groove, a cross-bar having a first portion resting in and having a shape conforming to the first groove, a second portion resting in and having a shape conforming to the second groove, and connected to each post at a top region of the respective post, two ground-contacting covers, each positioned around a respective post and free to rotate around the respective post, and two guards, each positioned around a respective post and free to rotate around the respective post.

6. The system of claim 5 wherein each guard is in contact with a ground-contacting cover.

7. The system of claim 5 wherein the outer surface of each ground-contacting cover is circular in horizontal cross-section.

8. The system of claim 5 wherein the outer surface of each guard is circular in horizontal cross-section.

9. The system of claim 5 wherein the diameter of the ground-contacting covers is greater than the diameter of the guards.

10. The system of claim 5 further comprising two ground-contacting base boxes, each positioned at a bottom region of the respective post.

11. The system of claim 10, wherein each guard is mounted on a respective ground-contacting base box.

12. A method of installing an opening protection system, the method comprising the steps of:

ground-anchoring two spaced-apart upright posts, positioning a first portion of a cross-bar into a first groove at a top end of a first post of the two upright posts, positioning a second portion of the cross-bar into a second groove at a top end of a second post of the two upright posts, connecting the cross-bar to each post at the top region end of the respective post, positioning two guards around a respective post that are free to rotate around the respective post.

13. The method of claim 12 further comprising positioning two ground-contacting covers around a respective post that are free to rotate around the respective post.

14. The method of claim 13 wherein each guard is in contact with a ground-contacting cover.

15. The method of claim 13 wherein the outer surface of each ground-contacting cover is circular in horizontal cross-section.

16. The method of claim 13 wherein the outer surface of each guard is circular in horizontal cross-section.

17. The method of claim 13 wherein the diameter of the ground-contacting covers is greater than the diameter of the guards.

18. The method of claim 13 further comprising positioning two ground-contacting base boxes at a bottom region of a respective post.

19. The method of claim 18, wherein each guard is mounted on a respective ground-contacting base box.

20. The method of claim 12 wherein positioning the first portion of the cross-bar into the first groove includes rotating a first rotatable member including the first groove to align the first groove with the cross-bar and positioning the second portion of the cross-bar into the second groove includes rotating a second rotatable member including the second groove to align the second groove with the cross-bar.

* * * * *